US008238510B2

(12) United States Patent
Haberman

(10) Patent No.: US 8,238,510 B2
(45) Date of Patent: Aug. 7, 2012

(54) STEAM GENERATOR DUAL HEAD SLUDGE LANCE AND PROCESS LANCING SYSTEM

(75) Inventor: Eric R. Haberman, White Oak, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 1078 days.

(21) Appl. No.: 12/145,828

(22) Filed: Jun. 25, 2008

(65) Prior Publication Data

US 2009/0010378 A1 Jan. 8, 2009

Related U.S. Application Data

(60) Provisional application No. 60/947,775, filed on Jul. 3, 2007.

(51) Int. Cl.

| | |
|---|---|
| ***G21C 19/00*** | (2006.01) |
| ***G21C 19/42*** | (2006.01) |
| ***B08B 9/00*** | (2006.01) |
| ***B08B 6/00*** | (2006.01) |
| ***B08B 3/12*** | (2006.01) |
| ***F22B 37/48*** | (2006.01) |
| ***F22B 37/54*** | (2006.01) |
| ***F22B 37/52*** | (2006.01) |
| ***F28G 1/12*** | (2006.01) |

(52) U.S. Cl. ..... 376/316; 376/260; 165/95; 122/379; 122/382; 122/392; 134/167 R; 134/177; 134/200; 134/172

(58) Field of Classification Search ..... 134/167, 134/177, 200, 172; 122/379, 382, 392; 165/95; 379/260, 316

See application file for complete search history.

(56) References Cited

U.S. PATENT DOCUMENTS

| | | | | |
|---|---|---|---|---|
| 4,079,701 | A | 3/1978 | Hickman et al. | |
| 4,273,076 | A | 6/1981 | Lahoda et al. | |
| 4,276,856 | A | 7/1981 | Dent et al. | |
| 4,572,284 | A * | 2/1986 | Katscher et al. | 165/95 |
| 4,676,201 | A | 6/1987 | Lahoda et al. | |
| 4,774,975 | A | 10/1988 | Ayers et al. | |
| 4,848,278 | A * | 7/1989 | Theiss | 122/383 |
| 4,899,697 | A | 2/1990 | Franklin et al. | |
| 4,921,662 | A | 5/1990 | Franklin et al. | |
| 4,971,140 | A * | 11/1990 | Stoss | 165/95 |
| 5,036,871 | A | 8/1991 | Ruggieri et al. | |
| 5,069,172 | A | 12/1991 | Shirey et al. | |
| 5,615,734 | A | 4/1997 | Hyp | |
| 5,813,370 | A * | 9/1998 | Owen et al. | 122/382 |
| 6,513,462 | B1 * | 2/2003 | Shiraishi et al. | 122/382 |
| 7,967,918 | B2 * | 6/2011 | Collin et al. | 134/167 R |

* cited by examiner

*Primary Examiner* — Erin M Leach

(57) ABSTRACT

A method of cleaning sludge from the tube sheet (34) of a nuclear steam generator (10) includes introducing a moveable sludge lance (76) said moveable sludge lance having duel lance heads (77) through handholes (62) in the side of the generator and into a central tube lane (60) having a central stay rod (61) and sludge lancing with high pressure fluid through the row 1 tubes (85) in the tube lane, where the distance (200) between the dual lance heads (77) is wide enough to allow the dual lance heads to extend beyond the central stay rod (61).

10 Claims, 4 Drawing Sheets

STEAM GENERATOR DUAL HEAD SLUDGE LANCE AND PROCESS LANCING SYSTEM

CROSS-REFERENCE TO RELATED APPLICATION

This application claims the benefit of U.S. Provisional Patent Application Ser. No. 60/947,775, filed Jul. 3, 2007.

FIELD OF THE INVENTION

This invention relates to steam generators and more particularly to methods for removing sludge deposits from the tubesheets of steam generators, particularly nuclear steam generators using a dual head sludge lance that can bypass and extend beyond the central rod of the tube sheet support.

BACKGROUND OF THE INVENTION

A typical nuclear steam generator comprises a vertically-oriented shell, a plurality of U-shaped tubes disposed in the shell so as to form a tube bundle, a tube-sheet for supporting the tubes at the ends opposite the U-like curvature, a dividing plate that cooperates with the tubesheet forming a primary fluid inlet plenum at the one end of the tube bundle and a primary fluid outlet plenum at the other end of the tube bundle. A primary fluid inlet nozzle is in fluid communication with the primary fluid inlet plenum, and a primary fluid outlet nozzle is in fluid communication with the primary fluid plenum. This configuration is described for example by U.S. Pat. Nos. 4,079,701; 4,723,076; 4,899,697 and 4,921,662 (Hickman et al.; Lahoda et al.; Franklin et al. and Franklin et al.; respectively).

Since the primary fluid contains radioactive particles and is isolated from feedwater only by the U-tube walls, which may be constructed of Inconel®, the U-tube walls form part of the primary boundary for isolating these radioactive particles. It is, therefore, important that the U-tubes be maintained defect-free so that no leaks/breaks will occur in the U-tubes.

It has been found that there are at least two causes of potential leaks in the U-tube walls. High caustic levels found in the vicinity of the cracks in tube specimens taken from operating steam generators and the similarity of these cracks to failures produced by caustic under controlled laboratory conditions, have identified high caustic levels as the possible cause of the intergranular corrosion, and thus the possible cause of the tube cracking.

The other cause of tube leaks is thought to be tube thinning. Eddy current tests of the tubes have indicated that the thinning occurs on tubes near the tubesheet at levels corresponding to the levels of sludge that has accumulated on the tubesheet. The sludge is mainly iron oxide particulates and copper compounds along with traces of other minerals that have settled out of the feedwater onto the tubesheet, and into the annulus between the tube sheet and the tubes. The level of sludge accumulation may be inferred by eddy current testing with a low frequency signal that is sensitive to the magnetite in the sludge. The correlation between sludge levels and the tube wall thinning location strongly suggests that the sludge deposits provide a site for concentration of phosphate solution or other corrosive agents at the tube wall that results in tube thinning.

Additionally each of the U-shaped heat exchanger tubes has a "hot leg" U-bend at its top and both "hot and cold legs" at the bottom end of each heat exchanger. Usually the bottom hot and cold legs are sludge treated/suctioned separately.

A number of patents have previously described moveable, high pressure, single head, sludge lance-suction methods of removing top tubesheet sludge including, for example, the patents previously set out, as well as U.S. Pat. Nos. 4,276,856; 4,676,201; 4,774,975; 5,036,871; 5,069,172 and 5,615,734 (Dent et al.; Lahoda et al.; Ayres et al.; Ruggieri et al.; Shirey et al.; and Hyp.; respectively). These sludge removal methods are utilized after an initial chemical cleaning which reduces the hard (tenaciously adhering) sludge on the tube sheet, especially in a "kidney" shaped high accumulation region in the hot leg zone, to a generally particulate film.

In most nuclear steam generators in service today, there are usually 6 inch (15.2 cm.) diameter hand holes in the shell of the steam generator near and above the tubesheet that has an associated hole in the wrapper providing access to the tubesheet for removal of the sludge deposits on the tubesheet.

In all the above apparatus, the single head used must stop at a central rod in the tube sheet, so that the central row of tubes across the tube lane and the hot and cold leg is difficult to clean, and that central row of tubes also crosses the middle of the "kidney" region of the hot leg. It is essential to remove sludge from 100% of the tubes and tubesheet surface. Leaving 5% or 10% of the sludge removal in a marginal state jeopardizes the entire sludge removal process, since it only takes a single leaking tube for potential contamination by radioactive particles from the primary fluid which is under high pressure and at about 650° C. Thus there is a need for a method that can clean that central row effectively, and a main object of this invention is to provide such a method and apparatus.

SUMMARY OF THE INVENTION

The above mentioned problems are solved and object accomplished by providing a method of sludge lancing the secondary side of a tube bundle in a tubular steam generator having a plurality of entry handholes allowing access to a center tube lane, the bundle having a hot leg side and a cold leg side separated by the center tube lane which lane at its mid point has a central stay rod, comprising the steps of:

1) opening at least one handhole; 2) introducing a moveable sludge lance having dual lance heads separated by a distance greater than the diameter of the central stay rod; and 3) sludge lancing the hot leg side and the cold leg side of the tube bundle with the moveable sludge lance, so that the dual lance heads traverse the central tube lane to extend beyond the central stay rod allowing continuous and complete lancing of the hot and cold sides of the tube bundle.

The invention also resides in a moveable sludge lance for use in lancing a tube bundle in a tubular steam generator by travel in a center tube lane to a mid point center stay rod; said sludge lance comprising dual lance heads separated a distance greater than the diameter of the central stay rod used in the generator, wherein the dual lance heads can extend beyond the central stay rod, wherein the dual lance heads have a common frame and wherein a monorail provides a rigid platform for the dual lance heads, a rolling kickstand provides forward support for the monorail, and a jaw located forward of the kickstand can register the central stay rod with the forward position of the monorail.

BRIEF DESCRIPTION OF THE DRAWINGS

While the specification concludes with claims particularly pointing out and distinctly claiming the subject matter of the invention; it is believed the invention will be better understood from the following description, taken in conjunction with the accompanying drawings, wherein:

As used herein the term "sludge lancing" or "sludge lance" means high pressure fluid cleaning through a plurality of nozzle jets on the sludge lance, which jets direct the fluid between the tubes in a steam generator and onto the tube sheet. The fluid is usually water and the jets align with tube row lanes formed by the spaces between rows of tubes. Also, as used herein, the term "dual heads" means a combination of at least cantilevered reaction bars, lance barrel assemblies and high pressure jet nozzles.

DESCRIPTION OF THE PREFERRED EMBODIMENTS

In a U-tube type steam generator, a tube sheet supports a bundle of heat transfer U-tubes. During operation, sludge forms on the tube sheet around the U-tubes and in the annulus between the U-tubes and the tube sheet, causing potential failure of the tubes. Failure of the tubes may result in a release of radioactive particles from the primary reactor coolant into the feedwater of the steam generator. The invention, herein described, is a method for removing this sludge accumulation before it causes tube failure.

Figure 1:
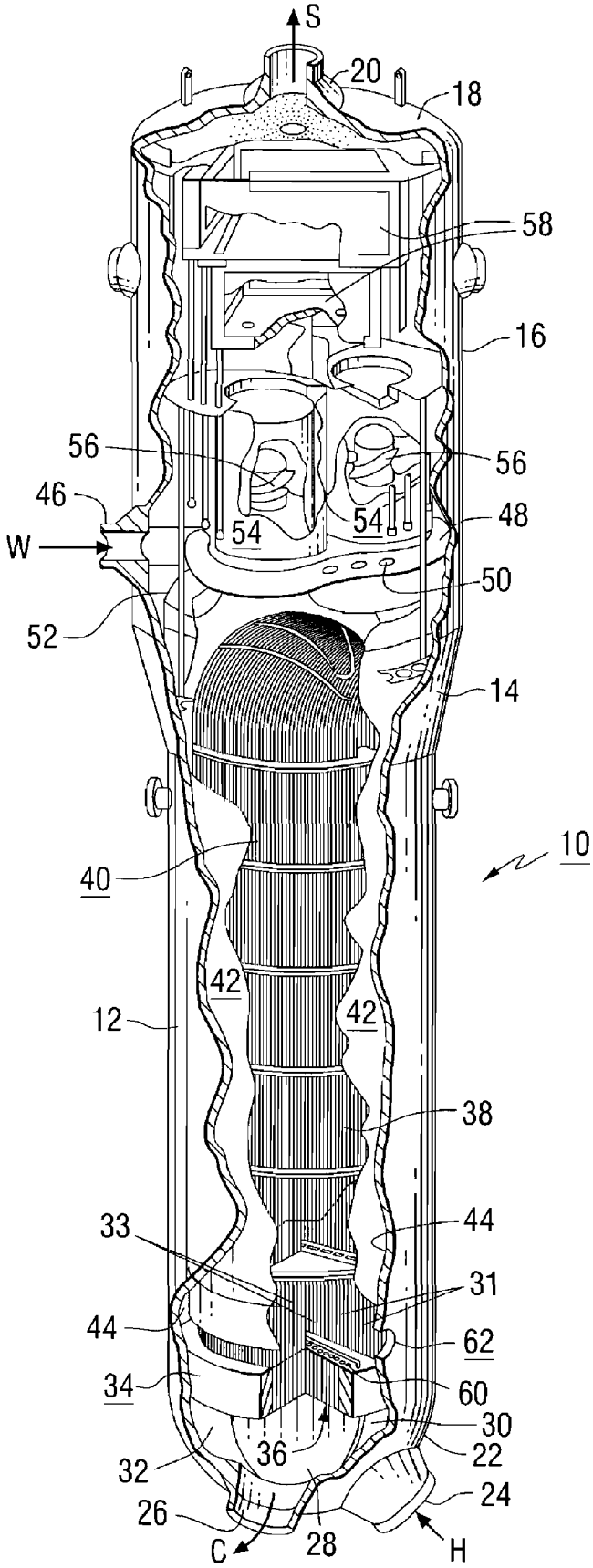
FIG. 1 PRIOR ART
FIG. 1 is a partial cross-sectional view in elevation of one example of a typical prior art steam generator.

Referring to FIG. 1, prior art nuclear steam generators includes a primary side 2 and a secondary side 4 among the tube bundle 40 (best shown in FIG. 3), hydraulically isolated from one another by a tubesheet 34. The nuclear steam generator referred to generally as 10, comprises a lower shell 12 connected to a frustoconical transition shell 14 which connects lower shell 12 to an upper shell 16. A dished head 18 having a steam nozzle 20 disposed thereon encloses upper shell 16 while a substantially spherical head 22 having inlet nozzle 24 and an outlet nozzle 26 disposed thereon encloses lower shell 12. A dividing plate 28 centrally disposed in substantially spherical head 22 divides the substantially spherical head 22 into an inlet compartment 30 and an outlet compartment 32.

The inlet compartment 30 is in fluid communication with inlet nozzle 24 while outlet compartment 32 is in fluid communication with outlet nozzle 26. A tube sheet 34, having tube holes 36 therein, is attached to lower shell 12 and substantially spherical head 22 so as to isolate the portion of steam generator 10 above tube sheet 34 from the portion below tube sheet 34 in a fluid tight manner.

Tubes 38 which are heat transfer tubes shaped with a U-like curvature are disposed in tube holes 36. The tubes 38 which may number about 7,000 form a tube bundle 40. Dividing plate 28 is attached to tube sheet 34 so that inlet compartment 30 is physically divided from outlet compartment 32. Each tube 38 extends from tube sheet 34 where one end of each tube 38 is in fluid communication with inlet compartment 30, up into transition shell 14 where each tube 38 is formed in a U-like configuration, and back down to tube sheet 34 where the other end of each tube 38 passes through the tube sheet to be in fluid communication with outlet compartment 32.

In operation, hot reactor coolant fluid H having been heated from circulation through the reactor core enters steam generator 10 through inlet nozzle 24 and flows into inlet compartment 30. From inlet compartment 30, the reactor coolant fluid flows through tubes 38 in tube sheet 34, up through the U-shaped curvature of tubes 38, down through tubes 38 into outlet compartment 32. From outlet compartment 32, the now cooler (due to heat transfer) reactor coolant C is passed through outlet nozzle 26 and circulated through the remainder of the reactor coolant system. The inlet side of the tube bundle provides a tube hot leg 31 and tube return provides a tube cold leg 33 which exits to outlet compartment 32.

Again referring to FIG. 1, tube bundle 40 is encircled by a wrapper 42 which extends from near the tube sheet 34 into the region of transition shell 14. Wrapper 42 together with lower shell 12 form an annular chamber 44. A secondary fluid or feedwater inlet nozzle 46 is disposed on upper shell 16 above tube bundle 40 inlets water W. A feedwater header 48 comprising three loops forming a generally cloverleaf-shaped ring is attached to feedwater inlet nozzle 46. Feedwater header 48 has therein a plurality of discharge ports 50 arranged in varying arrays so that a greater number of discharge ports 50 are directed toward annular chamber 44 than are directed otherwise.

During operation, inlet feedwater W enters steam generator 10 through feedwater inlet nozzle 46, flows through feedwater header 48, and out of feedwater header 48 through discharge ports 50. The greater portion of the feedwater exiting discharge ports 50, flow down annular chamber 44 until the feedwater contacts tube sheet 34. Once reaching the bottom of annular chamber 44 near tube sheet 34, the feedwater is directed inward around tubes 38 of tube bundle 40 where the feedwater passes in a heat transfer relationship with tubes 38. The hot reactor coolant fluid H being in tubes 38 transfers heat through tubes 38 to the feedwater thereby heating the feedwater. The heated feedwater then rises by natural circulation up through the tube bundle 40. In its travel around tube bundle 40, the feedwater continues to be heated until steam S is produced and passes through steam nozzle 20.

Now referring to the upper portion of FIG. 1, wrapper 42 has an upper cover or wrapper head 52 disposed thereon above tube bundle 40. Disposed on wrapper head 52 are sleeves 54 which are in fluid communication with the steam produced near tube bundle 40 and have centrifugal swirl vanes 56 disposed therein. Disposed above sleeves 54 is a moisture separator 58.

Referring now to the lower portion of FIG. 1, due to the curvature of tubes 38, a straight line section of tube sheet 34 is without tubes therein. This straight line section is referred to as central tube lane 60. In conjunction with central tube lane 60, two handholes 62 and 63 (only 62 shown in FIG. 1) are provided, diametrically opposite each other and in collinear alignment with the tube lane 60. Handholes 62 are 6 inch to 8 inch (15.2 cm to 20.3 cm) diameter ports that allow limited access to the tube sheet 34 area.

Experience has shown that during steam generator operation sludge may form on tube sheet 34 around tubes 38 from the feedwater W. This sludge which usually comprises iron oxides, copper compounds, and other metals is formed from these materials settling out of the feedwater onto tube sheet 34. The sludge can produce defects over time in the tubes 38, which can allow radioactive particles in the reactor coolant contained in tubes 38 to leak out into the feedwater and steam S of the steam generator.

Figure 2:
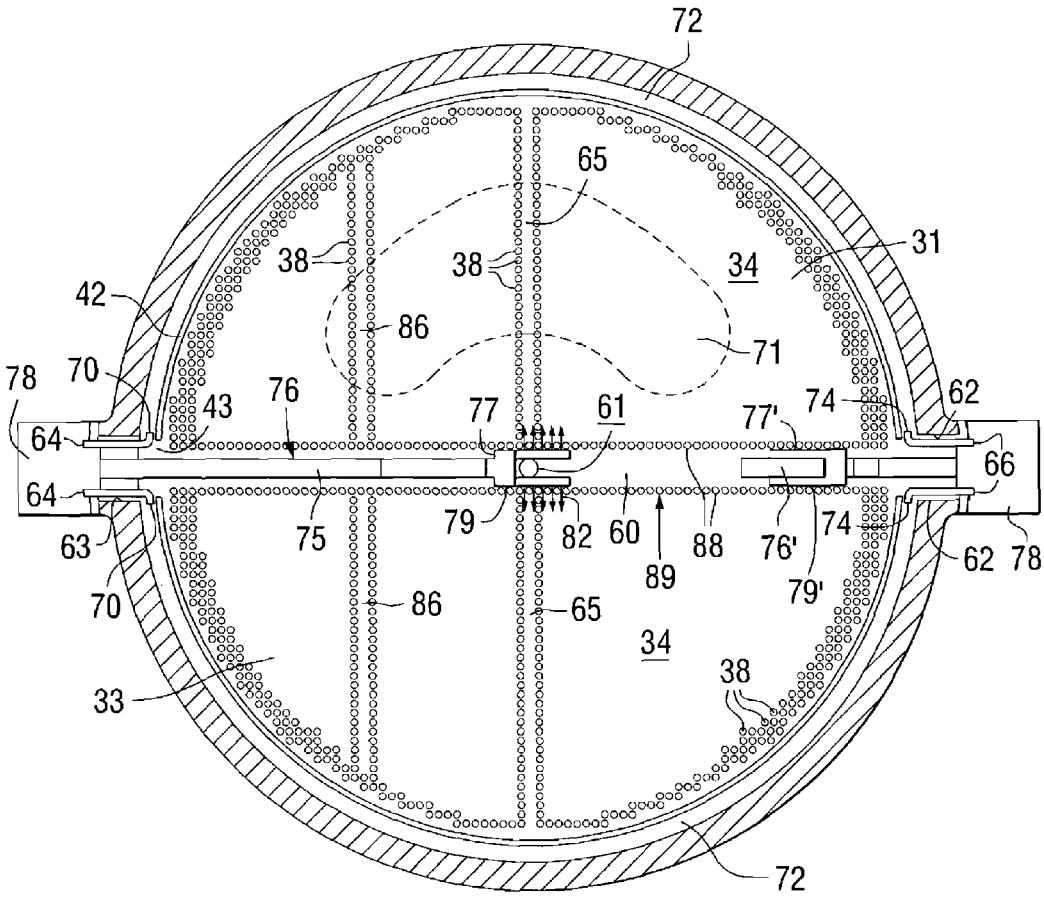
FIG. 2 is a plan view of the tube sheet and tubes in a steam generator.

Referring now to FIG. 2, when the reactor is not operating such as during refueling, the steam generator may be deactivated and drained of the feedwater. Both handholes 62 and 63 can then be opened to provide access to the interior of the steam generator. An injection header 64 can be placed through one of the handholes 63 while a suction header 66 can be placed through the other handhole 62. The injection header 64 and the suction header 66 are shaped to fit through the handholes 62 and 63 while being able to fit around any obstructions which might block the central tube lane 60 which may be present near the handholes 62 and 63.

The injection header 64 is formed so that the two outlets 70 come to rest near the level of sludge accumulation on tube sheet 34. In addition, the outlets 70 which may be 9/16 inch (1.4 cm) nozzles face opposite each other in the direction of annulus peripheral lane 72 which is formed around the tube bundle 40. Likewise, the inlets 74 of suction header 66 face opposite each other while facing annulus peripheral lane 72. Injection header 64 is connected to a fluid supply such as a water supply and suction header 66 is connected to a suction pump (not shown) such as an air diaphragm suction pump.

Figure 3:
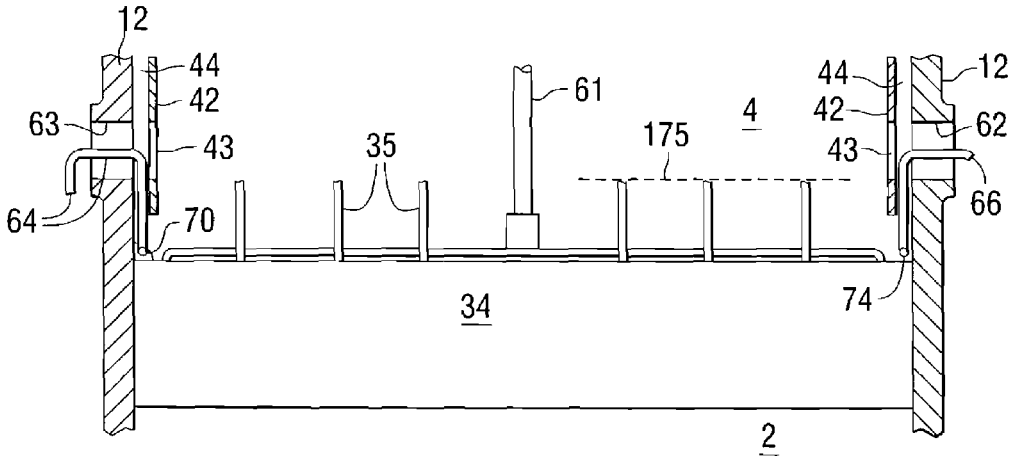
FIG. 3 PRIOR ART
FIG. 3 is a cross-sectional view in elevation of a typical steam generator near the tube sheet, showing the central stay rod in the center tube lane of the tube sheet.

Then, according to this invention, a moveable high pressure, sludge lance 76 having dual heads 77 and 79 is inserted into at least one of the handholes 62 and 63, through an opening in the wrapper 43 where it proceeds down one section of the central tube lane 60, down between row 1 tubes 88 to clean between adjacent tube gaps 89 which are very small, as generally shown in FIG. 2. As can be seen, the dual heads 77 and 79, having included lance assemblies fitted with high pressure nozzle jets/holes, connected to a cleaning fluid supply, to eject cleaning fluid 82 (shown as arrows), such as pressurized water, can extend beyond the end of integral support frame 75, such as monrail 208 shown in FIG. 5, to allow cleaning around the central stay rod 61 which helps support the tube sheet 34. This allows cleaning of all tube rows including the central cross row 65 of tubes, transverse to central tube lane 60 and centered on the central stay rod 61, as will be described in detail later. Advantageously, a second moveable, high pressure sludge lance 76' having dual heads 77' and 79' also fitted with nozzle jets/holes, connected to a cleaning fluid supply, is also shown moving down another section of the central tube lane 60 simultaneously. It will also stop at the central stay rod 61 generally shown in FIG. 3. Preferably, both moveable, high pressure sludge lances are operated simultaneously sludge lancing both the tube hot leg 31 and the tube cold leg 33. Returning to FIG. 2, also shown is the central cross row 65 of tubes across the tube lane 60, the tube hot leg 31 and tube cold leg 33 of the tube bundle, and the "kidney" shaped high sludge accumulation region 71 (shown by dashed lines) where most hard sludge develops. Other tube lanes are shown as 86 and individual tubes as 38. The opening in the wrapper 42 is shown as 43. In FIG. 3, tube lane water block velocity structures 35 which slow down the velocity of water entering the central tube lane are shown bonded to the tube sheet 34.

Figure 5:
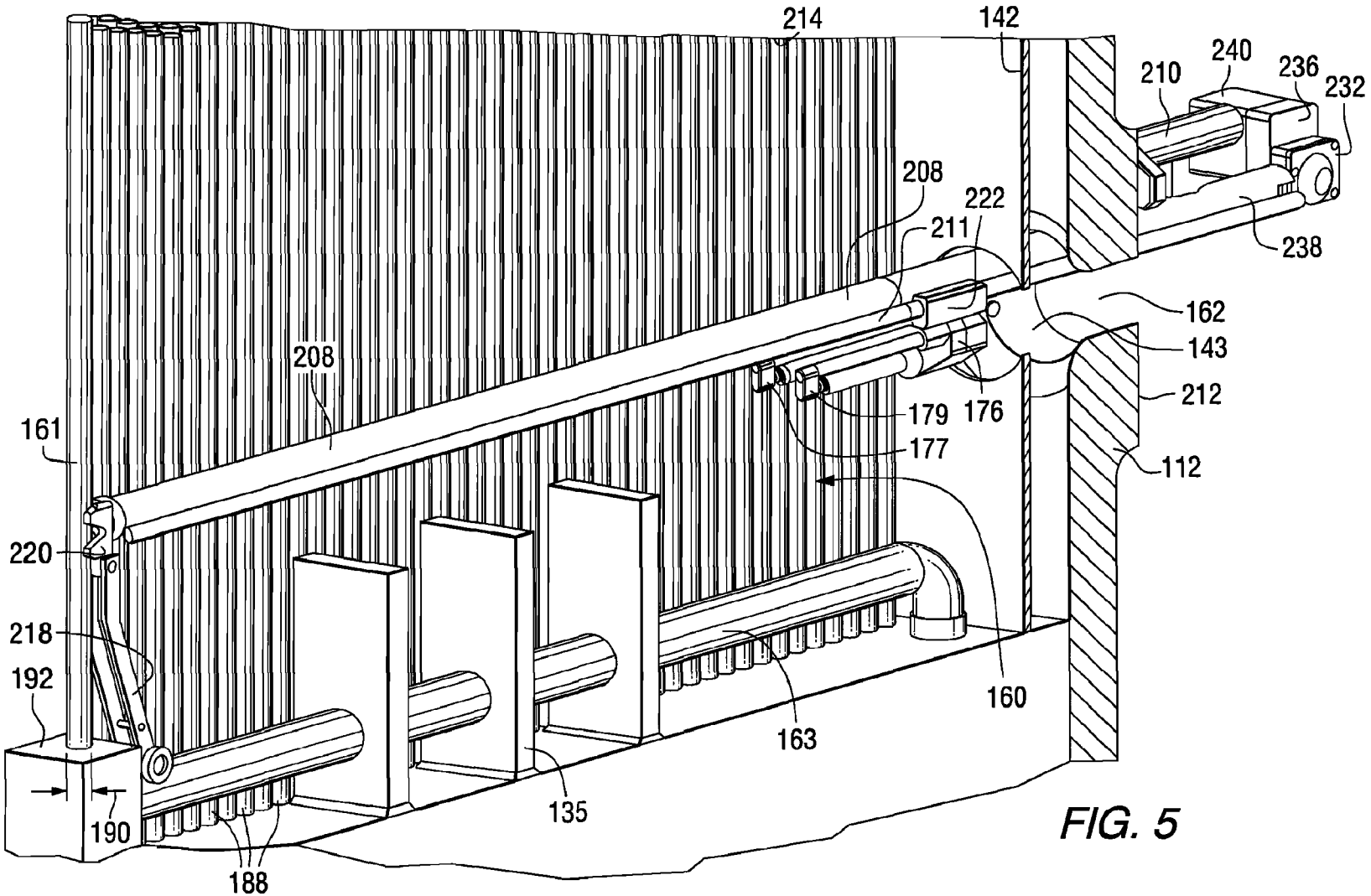
FIG. 5, which best shows the invention, is a partial-sectioned three dimensional view of the entire sludge lance apparatus of this invention, inserted into a hand hole in the lower shell of the steam generator and able to traverse the central tube lane over various support structures, to the central stay rod of the tube sheet support, where the dual head of the sludge lance can bypass and extend beyond the central stay rod.

The sludge lance of this invention, comprises a mounting mechanism 78 which is capable of being bolted to the area surrounding handhole 62 or 63. Once the lance is in place, the water supply to injection header 64 is activated while the suction pump associated with suction header 66 is activated. The flow of water from outlets 70 causes a peripheral stream of water to be established from outlets 70, through annulus peripheral lane 72 into inlets 74 of suction header 66. As shown in FIG. 5, the sludge lance of this invention is capable of passing over obstructions such tube lane blocks to reach the endpoint at the central stay rod 161. For example a dual head insertion device such as a flat thin support can be laid on the top of the tube lane block 135 along plane 175, shown in FIG. 3, to allow ease of travel to the endpoint.

Figure 4:
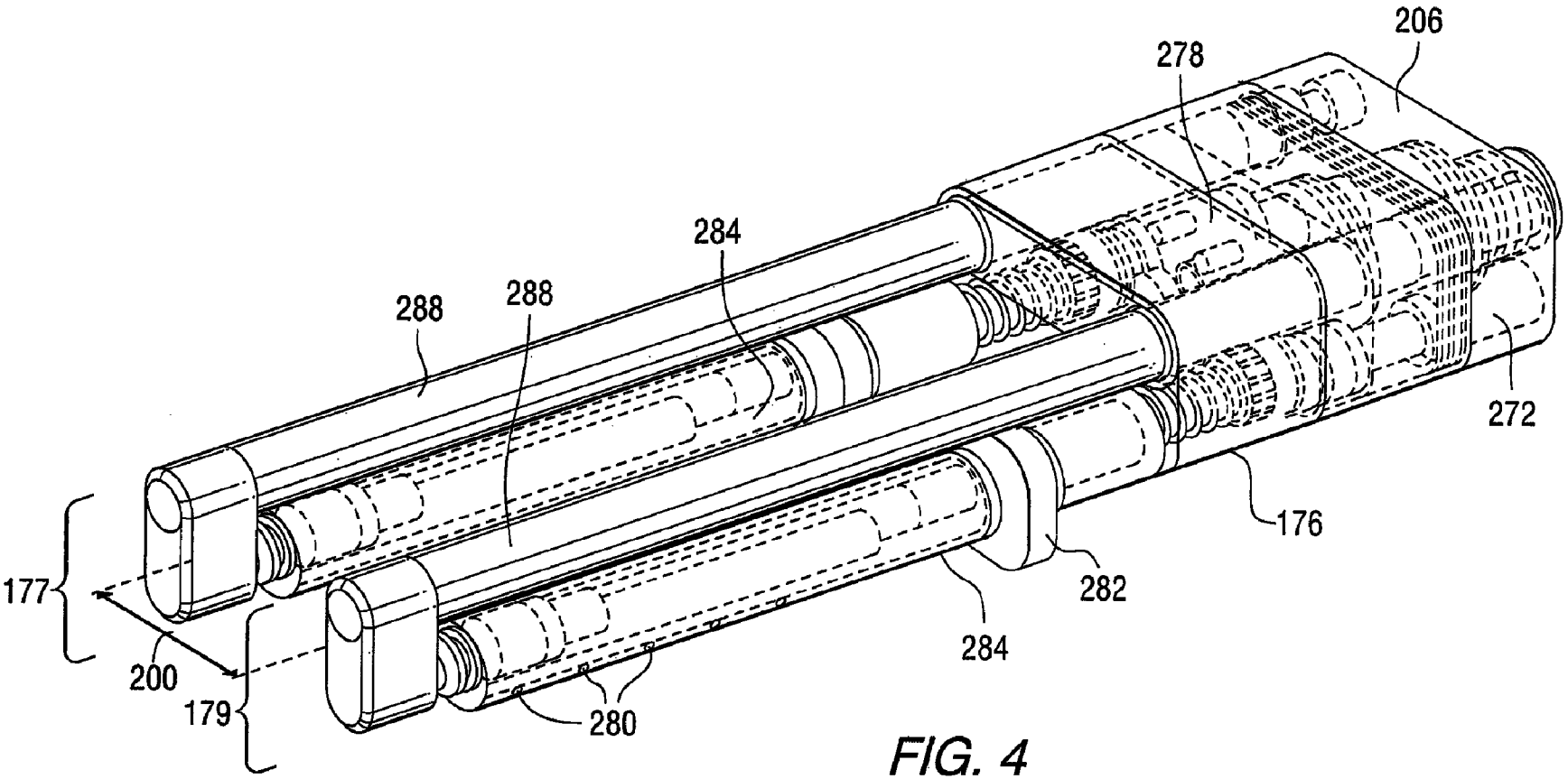
FIG. 4 is a partial-sectioned three dimensional view of the sludge lance of this invention, having dual heads for cleaning.

Referring specifically now to FIGS. 4 and 5, one moveable, high pressure sludge lance 176 is shown with dual heads 177 and 179, with included lance barrel assemblies 284 having a plurality, usually 4 to 6 high pressure jet nozzles 280 connected to a cleaning fluid supply, to eject cleaning fluid such as pressurized water. The dual heads 177 and 179 and lance barrel assemblies are spaced apart by a distance 200 which is large enough to by pass central stay rod 161 but not hit or scrape row 1 tubes 188. As used herein, the term "dual heads" 179 and 179 means cantilevered reaction bars 288, lance barrel assemblies 284 and high pressure jet nozzles 280. Gaps between the tubes are best shown in FIG. 2 as 89. The distance 200 is generally between 1.70 inches and 1.75 inches (4.32 cm and 4.44 cm). Also shown in FIG. 5 are the lower shell 112, wrapper 142, opening in the wrapper 143, hand hole 162, blow down tube 163, tube lane blocks 135, central tube lane 160 and diameter 190 of the central stay rod inserted into a stay rod support block 192.

The sludge lance system of this invention can reduce lancing time by 50%. This is accomplished by the preferred simultaneous lancing of the hot and cold leg side of a steam generator secondary side tubesheet. In FIG. 5, a reciprocating mechanism driven by a flexible shaft produces oscillation motion of two dual heads 177 and 179 containing parallel and independent cantilevered reaction bars 288 and lance barrels assemblies 284 containing high pressure nozzles 280, which can be single holes. These are supported by a common support frame 206. The common support frame 206 is supported by a monorail 208 that is suspended in the central tubelane 160, that is, supported by the center stayrod 161, and a monorail hanger 210 attached to the handhole pad face 212. The independent dual heads have sufficient axial compliance combined with a tube gap locating knuckle to automatically align with any adjacent mis-drilled Row 1 tubes 188.

The sludge lance system of this invention is comprised of 6 major components:

1) A monorail 208 which provides a rigid platform for precise location of the Row 1 tubes 188 and tube gaps 214. It is assembled in 3 pieces with interconnecting sockets and register pins to hold the rail sections together while it is inserted in the central tube lane. A rolling kickstand 218 provides forward support of the monorail 208, during insertion and assembly in the steam generator tube central lane 160. A jaw 220 located forward of the rolling kickstand 218 registers on the center stayrod 161 to center the forward end of the monorail. The jaw engages a duplicate monorail assembly (shown in FIG. 2) which can be installed simultaneously in the opposing tubelane handhole. There are no exposed fasteners between the rail assemblies that could become foreign objects in the bundle.

2) A carriage 222, mounted on the monorail and having the dual heads 177 and 179 attached traverses the monorail 208 is machined from aluminum alloy billet with a series of upper and lower roller sleeves and bearings (not shown for sake of simplicity) providing a low friction connection between it and the monorail rails 211. Locomotion of the carriage is accomplished by a continuous timing belt (not shown) running between the index gearbox assembly 232 and a tensioning system (in the form of a gas spring and bearing supported cog wheel—not shown as interior to the monorail) located in the forward end of the monorail.

3) A gearbox assembly 236 provides either incremental or continuous translation of the carriage from one end of the monorail to the other. The socket end of the gearbox 238, which locates the continuous timing belt both axially and parallel to the monorail, contains a screw-driven wedge assembly 240 that extends forward as the screw is rotated clockwise, and applies a compressive force on a series of pushrods that terminates at the aft end of a gas spring which is supported by the forward cog wheel and cross-axle translating in a horizontal slot in the forward end of the monorail. Since the length of the timing belt is fixed between the cog wheels, the applied compressive force of the screw-drive wedge assembly against the cog wheels, the applied compressive force of the screw-drive wedge assembly against the pushrods forces the timing belt to the prescribed operating tension.

4) A monorail 208 is supported at the handhole end of the tubelane by a specifically designed monorail hanger 210 and lug that is positioned on and attached to the upper threaded holes (used for cover closure) in the handhole pad face 212. The hanger 210 contains a threaded shaft and torque limiter that is rotated clockwise to position a lug over a clevis on the monorail 208; the monorail 208 is raised into the lug and pinned through the clevis to support the monorail 208 horizontally in the central tubelane 160. The hanger 210 has sufficient lateral movement to accommodate a 0.6 degree radial shift in the position of the handhole relative the central tubelane centerline. Once positioned along the centerline of the central tubelane, the monorail is forced in compression against the central stayrod 161 by the clockwise rotation a torque limiter which unloads at the force required to secure the monorail in the tubelane against the jaw 220 of the opposing monorail (not shown).

5) An automated take-up reel which is positioned on the handhole pad face 212 to provide end effector cable and hose management. The take-up reel houses a flexible shaft drive not shown which provides oscillation motion to a lance end effector thus eliminating any electromotive interference that may be generated by a stepper motor in close proximity to the Row 1 tubes 188—this allows sludge lancing to be accomplished simultaneous with Eddy Current testing of the tube bundle. A pair of ⅜" (0.95 cm) high pressure hoses are attached to the central axle of a take-up reel to provide high pressure flow to the lance head.

The moveable, high pressure sludge lance 176 is attached to the bottom side of the carriage by means of a set of four button head fasteners that engage keyhole type slots in the carriage; a lance end effector is further latched to prevent dislocation of the end effector from the carriage in the tubelane. The sludge lance end effector incorporates a mechanical oscillation mechanism 278 driven by the flexible shaft drive which permits simultaneous lancing of both hot and cold legs of the steam generator tube sheet by cleaning fluid input through high pressure hoses 272. The lance barrel assemblies 284 have ½" (1.27 mm) of axial compliance allowing precise and independent alignment of a high pressure jet nozzles 280 within the adjacent tube gaps. The alignment is accomplished during the oscillation cycle of the lance barrels; a thermoplastic knuckle 282 located one (1) tube pitch aft of the first high pressure jet is rotated in the gap generated by the pitch (or spacing) of the Row 1 tubes 188. The thermoplastic knuckle 282 is designed similar to a wedge with a slightly smaller cross-section than the geometry generated by the Row 1 tube diameter and pitch. If the tube alignment becomes asymmetrical on the secondary side of the tubesheet, the knuckle is forced laterally during the oscillation (rotation) sequence and further rotated into the tube thus aligning the high pressure jets within the adjacent tube gaps.

The lance barrel assembly 284 does not incorporate commercially available removable jets due to the potential for loose parts in the steam generator. Sludge lancing/jetting is accomplished by drilling jet nozzles 280 or jet holes of a specific diameter in the lance barrel assembly 284 to yield the correct system parameters. The high pressure jets nozzles 280 maintain a 6:1 length to diameter ratio which is sufficient for collimation of the high pressure jet in the tube gap. The lance barrel assemblies are supported on either end axially by a set of needle roller bearings and further supported horizontally by a set of cantilevered reaction bars which resist the thrust force of the lance under full system pressure, thus allowing the dual head 177 and 179 bodies to act independently of each other. The reaction bars are set parallel to each other and separated by a distance 200 slightly greater than the diameter of the central stayrod 161, thus allowing the lance barrel assemblies 284 to index past the central stayrod 161 and perform central stayrod region lancing for example in the central cross row of tubes 65 (as shown in FIG. 3).

While there is described what is now considered to be the preferred embodiment of the invention, it is, of course, understood that various other modifications and variations will occur to those skilled in the art. The claims, therefore, are intended to include all such modifications and variations which fall within the true spirit and scope of the present invention.

What is claimed is:

1. A method of sludge lancing a tube bundle in a tubular steam generator having a plurality of entry handholes allowing access to a center tube lane, the tube bundle having a hot leg side and a cold leg side separated by the center tube lane which lane at its mid point intersects a central cross row of tubes and has a central stay rod, comprising the steps of:

1) opening at least one handhole opening into a center tube lane;

2) introducing at least one moveable sludge lance, fitted with nozzle jets and having dual lance heads, separated a distance greater than the diameter of the central stay rod, into the center tube lane moving on a monorail which provides a rigid platform for the dual lance heads, and a rolling kickstand which movement provides a forward support for the monorail; and 3) sludge lancing the tube bundle with cleaning fluid passing to the moveable sludge lance, so that the dual lance heads traverse the central tube lane to extend beyond the central stay rod allowing continuous and complete cleaning of the tube bundle, where a gearbox assembly passes the sludge lance from one end of the monorail to the other, and the dual lance heads, having cantilevered reaction bars and lance barrel assemblies with jet nozzles all parallel to the monorail axis, are attached to a monorail carriage combination which carriage traverses the monorail axis by means of monorail rails parallel to the monorail, and a jaw means, located forward of the kickstand, registers the center stay rod to center the monorail.

2. The method of claim 1, wherein the dual lance heads have a common frame and both the hot leg side and the cold leg side of the tube bundle is sludge lanced.

3. The method of claim 1, wherein two sludge lances having dual heads are introduced into entry handholes near each end of the center tube lane and sludge lancing is accomplished by using each sludge lance simultaneously.

4. The method of claim 1, wherein the distance separating the sludge lance heads is from about 4.32 cm to 4.44 cm.

5. The method of claim 1, wherein the sludge lance dual lance heads operate in an oscillation motion.

6. The method of claim 1, wherein the dual sludge lance heads have drilled jet holes allowing lancing.

7. The method of claim 1, wherein the dual lance heads are transversed to extend beyond an end point of the central stay rod to sludge lance the central cross row of tubes and a kidney shaped high sludge accumulation region.

8. The method of claim 1, wherein, in step (2) a flat support acting as a dual lance head support device is inserted into the center tube lane to allow ease of travel over any blocks in the center tube lane.

9. The method of claim 1, wherein the steam generator has a secondary side tube sheet, simultaneous lancing of the hot and cold leg side of the steam generator secondary side tube sheet uses a reciprocating mechanism driven by a flexible shaft that produces oscillation motion of two dual heads reducing lancing time by almost 50%.

10. The method of claim 1, wherein the monorail carriage provides incremental translation of the sludge lance.

* * * * *